US007110326B2

(12) United States Patent
Besse

(10) Patent No.: US 7,110,326 B2
(45) Date of Patent: Sep. 19, 2006

(54) TIMEPIECE DISPLAYING THE DAY OF THE MONTH

(75) Inventor: Laurent Besse, Villers-le-Lac (FR)

(73) Assignee: Zenith International S.A., Le Locle (CH)

( * ) Notice: Subject to any disclaimer, the term of this patent is extended or adjusted under 35 U.S.C. 154(b) by 30 days.

(21) Appl. No.: 10/517,266

(22) PCT Filed: May 30, 2003

(86) PCT No.: PCT/CH03/00335

§ 371 (c)(1),
(2), (4) Date: Dec. 6, 2004

(87) PCT Pub. No.: WO03/104904

PCT Pub. Date: Dec. 18, 2003

(65) Prior Publication Data

US 2005/0174891 A1 Aug. 11, 2005

(30) Foreign Application Priority Data

Jun. 6, 2002 (EP) ..... 02405454

(51) Int. Cl.
*G04B 19/20* (2006.01)
*G04B 19/24* (2006.01)

(52) U.S. Cl. ..... 368/37

(58) Field of Classification Search ..... 368/25–38
See application file for complete search history.

(56) References Cited

U.S. PATENT DOCUMENTS 4,257,113 A * 3/1981 Meister et al. ..... 368/35
6,081,483 A * 6/2000 Capt et al. ..... 368/28
6,574,167 B1 * 6/2003 Weissbach et al. ..... 368/35
6,738,316 B1 * 5/2004 Gabathuler et al. ..... 368/28
2003/0103417 A1 * 6/2003 Gabathuler et al. ..... 368/37
2003/0193840 A1 * 10/2003 Huter ..... 368/37

FOREIGN PATENT DOCUMENTS

| | | |
|---|---|---|
| CH | 316 461 A | 10/1956 |
| EP | 0 529 191 A | 3/1993 |
| EP | 1 070 996 A | 1/2001 |
| FR | 99 09425 | 7/1999 |

* cited by examiner

*Primary Examiner*—Vit W. Miska
(74) *Attorney, Agent, or Firm*—Browning Bushman P.C.; Hugh R. Kress

(57) ABSTRACT

The invention relates to a timepiece displaying the day of the month, characterized by the fact that said timepiece comprises two rotating disks (22, 24), which at least partly overlap and respectively display the digits and articles of the day of the month. Said two rotating disks (22, 24) are provided with the series of numbers 0 to 9 and the series of numbers 0, 1, 2, 3, 3, all of which are evenly distributed across a peripheral ring, and are disposed such that the numbers of one disk are displayed so as to be juxtaposed to the numbers of the other disk. The inventive timepiece also comprises a mechanism (12, 14, 28, 32, 38) driving the rotating disks in order for the juxtaposed numbers to indicate the day of the month.

10 Claims, 3 Drawing Sheets

TIMEPIECE DISPLAYING THE DAY OF THE MONTH

The present invention relates to a timepiece displaying the day of the month by means of two disks which support respectively the series of digits forming the tens and the units. Such a construction is essentially intended to produce a display of the day of the month with large digits.

A piece of this type is described, for example, in the patent application FR 99 09425. The tens disk supports the digits which twice form the series 0, 1, 2, 3 whereas the units disk supports the digits which form the series 0, 1, 2, 3, 4, 5, 6, 7, 8, 9. These disks are driven by two pinions which are associated with them and interact with the two overlapping plates of a control wheel, whose teeth are distributed and disposed such that the juxtaposed digits of the two disks provide an indication of the day of the month.

A piece of the same type is described in patent CH 316 461. The units disk then also supports the ten digits that form the series from 0 to 9, whereas the tens disk supports the series 1, 2, 3, space, 1, 2, 3, space.

Although these solutions are particularly novel, they are not the easiest to implement.

Therefore, the aim of the present invention is to provide a system of displaying the day of the month with large digits which, without making any concession to the security of operation, is particularly easy to implement.

More precisely, the invention concerns a timepiece displaying the day of the month, which comprises:

- two rotating disks, at least partially overlapping, serving to display respectively the units and the tens of the days of the month, which support, regularly distributed on a peripheral ring, the series of digits 0 to 9 and the series of digits 0, 1, 2, 3, 3, and are disposed in such a way as to present in juxtaposition the digits of the one with those of the other, and
- a mechanism for rotating these disks so that said juxtaposed digits provide an indication of the day of the month.

In a particularly advantageous manner, the drive mechanism comprises:

- a first crown wheel driven to make one revolution in thirty-one days by progressing by one step per day around midnight,
- an additional crown wheel attached to the first and possessing thirty regularly spaced teeth with the exception of two of them separated by a double space which corresponds to the absence of one tooth,
- a pinion with ten teeth integral with the units disk and driven by the teeth of the additional crown wheel,
- a wheel with thirty-one teeth engaging with said pinion,
- a wheel attached to the wheel with thirty-one teeth and having a first, a second, a third and a fourth lugs distributed such that the angles between the first and the second, the second and the third, the fourth and the first are substantially 116° and that the angle between the third and the fourth is substantially 11.6°, and
- a pinion with five teeth integral with the tens disks and driven by said lugs, which has an additional tooth disposed in order to be driven by the teeth of the additional crown wheel.

The timepiece according to the invention further exhibits, with preference, the following characteristics:

- the two disks have the same radius r and the spindles of the pinions integral with these disks are separated by a distance substantially equal to 2(r−e), e being the width of the rings supporting the digits of the units and of the tens;
- each of said pinions is associated with a jumper serving to position it;
- the units disk is slightly lower than the tens disk, which partially overlaps it in order to interact to present in juxtaposition the digits of their respective rings and is pierced, to the right of each of its digits, with an aperture allowing the units digits beneath it to be seen.

Other features of the invention will emerge from the description that follows, made with reference to the appended drawings in which.

Figure 1:
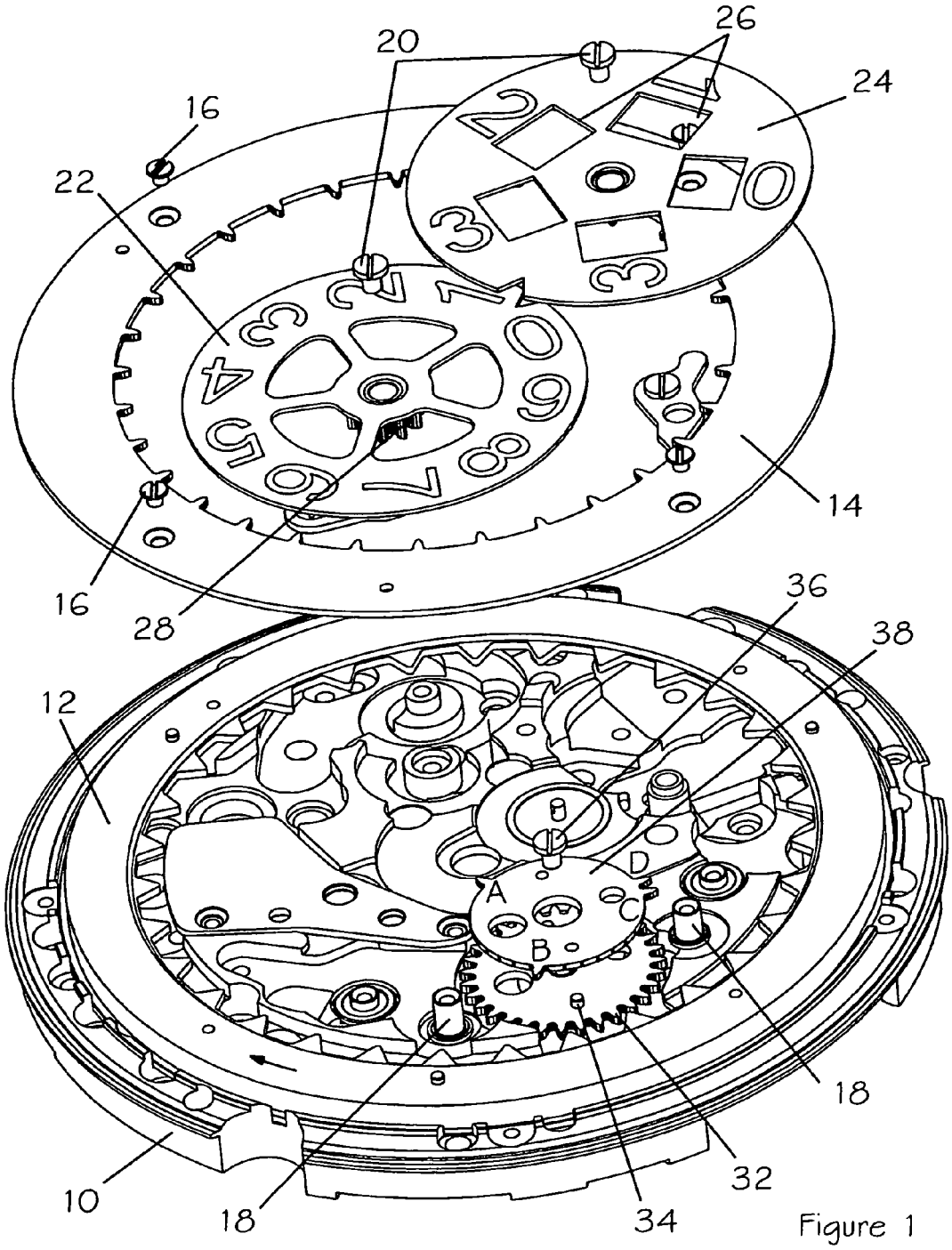
FIG. 1 is an exploded view of the timepiece according to the invention.

The timepiece shown in the drawing comprises, mounted on a plate 10, a day-of-the-month crown wheel 12 provided, toward the inside, with thirty-one teeth which have the function of receiving the pushing action of a drive finger moved from the hour wheel, in such a manner as to make one revolution in thirty-one days by progressing one step per day at midnight. These teeth also serve to be subjected to the action of a positioning jumper. Since such a mechanism is completely conventional and well known to those skilled in the art, it will not be described in greater detail.

The crown wheel 12 receives, on its top face, an additional crown wheel 14 which for its part is concentric and is attached to it with the aid of screws 16. This crown wheel has the particular feature of possessing, toward the inside, thirty regularly spaced teeth with the exception of two of them separated by a double space which therefore corresponds to the absence of one tooth.

The plate 10 supports, at 5 and 7 o'clock respectively, two posts 18 on which are pivotably mounted and attached by screws 20 two disks 22 and 24 of the same radius r.

The left disk 22 serves to display the units of the day of the month and supports, regularly distributed on a peripheral ring of width e, the series of digits 0 (or a blank) to 9.

The right disk 24 serves to display the tens of the day of the month and supports, regularly distributed on a peripheral ring of the same width e, the series of digits 0, 1, 2, 3, 3.

The units disk 22 is slightly lower than the tens disk 24, which partially overlaps it in order to interact to present in juxtaposition, at the 6 o'clock position, the digits of their respective rings which provide an indication of the day of the month. It will be noted that the tens disk 24 is pierced, to the right of each of its digits, with an aperture 26 allowing the digits of the units beneath it to be seen.

Naturally, so that the juxtaposition is correctly achieved, the distance separating the posts 18 forming the pivoting spindles of the disks must be substantially equal to 2(r−e).

To make it easier to understand the mechanism according to the invention, the various moving parts that constitute it have, on the drawing, been assigned arrows indicating their direction of rotation.

Figure 2:
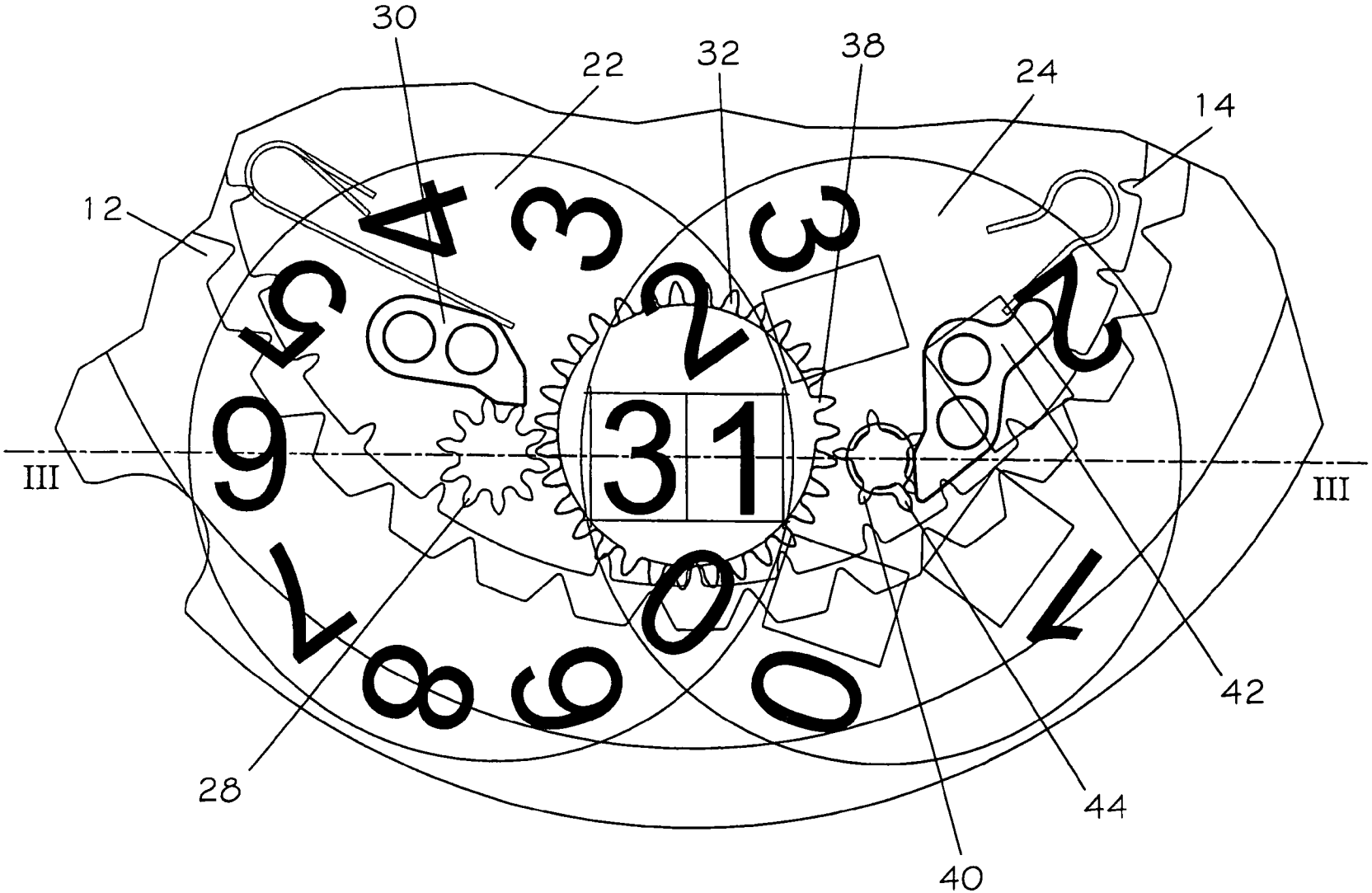
FIG. 2 is a partial plan view.
Figure 3:
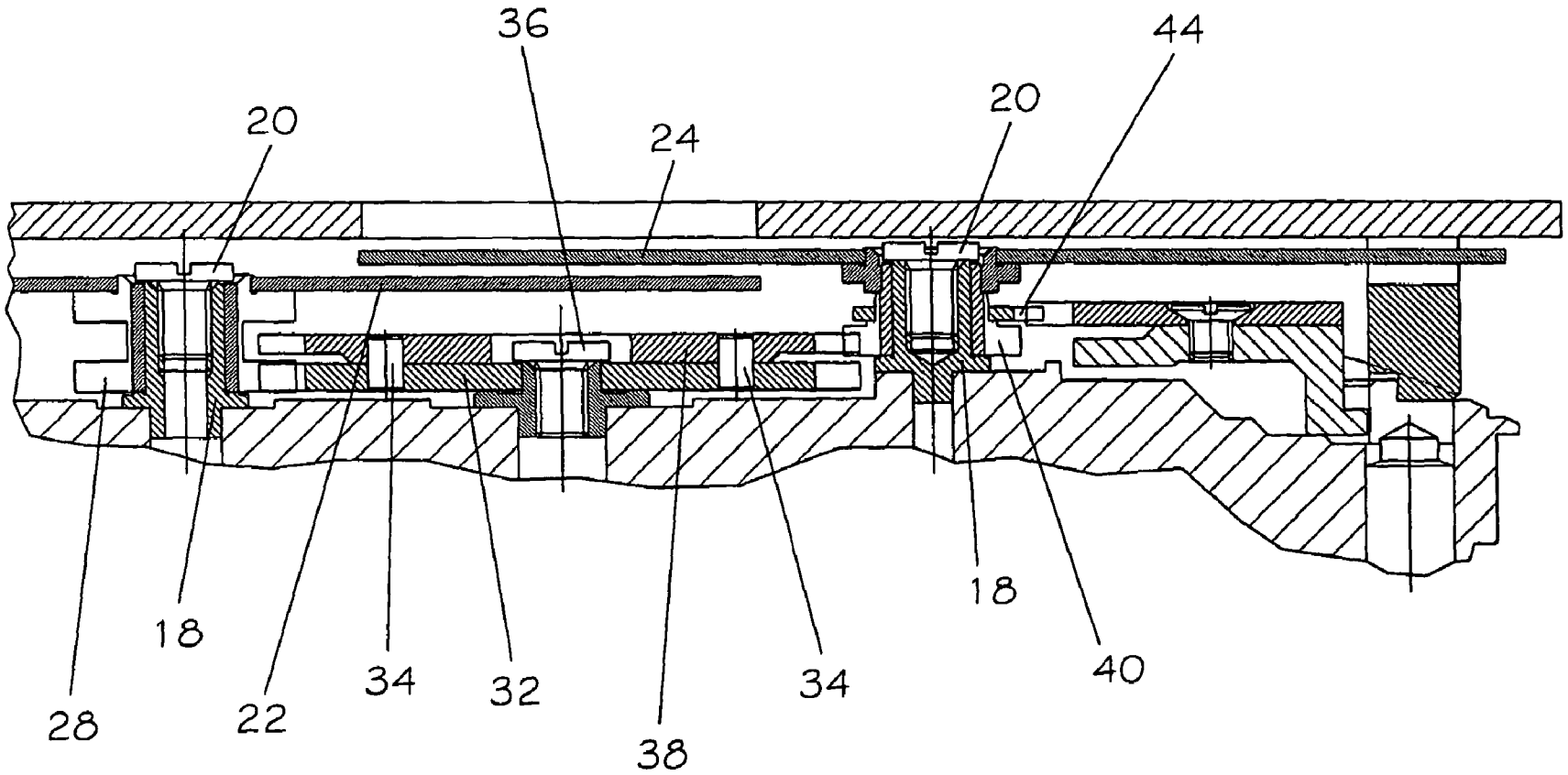
FIG. 3 is a view in section along III—III of this piece.

The units disk 22 is associated with a pinion 28 with ten teeth which is positioned by a jumper 30 (visible in FIG. 2 only) and actuated by the teeth of the additional crown wheel 14. It makes one revolution in ten days.

The pinion with ten teeth 28 engages with a wheel 32 with thirty-one teeth making one revolution in thirty-one days, on which is positioned with the aid of pins 34 and attached with the aid of screws 36, a wheel 38 having four lugs A, B, C and D. These lugs are distributed such that the angles between A and B, B and C, D and A are substantially 116° and that the angle between C and D is substantially 11.6°.

The wheel with four lugs 38 engages with a pinion 40 with five teeth (visible only in FIG. 2) making one revolution in thirty-one days, associated with the tens disk 24 and positioned by a jumper 42. This pinion has, at a level different from that of its five teeth, a sixth tooth 44 disposed in order to be pushed by one of the teeth of the additional crown wheel 14.

In the mechanism that has just been described, the various mobiles are initially disposed such that the functions exposed hereafter are performed.

Toward midnight, on the night of the first of each month, the pinion with ten teeth 28 receives from the additional crown wheel 14 a push which makes it advance one step and therefore brings the units disk 22 into the position in which it displays the digit 2 beside the digit 0 displayed by the tens disk 24. At the same time, the wheel with thirty-one teeth 32 and the wheel with four lugs 38 advance by one step, but the latter does not touch the pinion with five teeth 40. The tens disk 24 therefore remains in its position 0. The display is then 02.

On the night of the ninth of each month, the pinion 28 advances the units disk 22 to the position in which it displays the digit 0. At the same time, the wheel 32 and the wheel 38 advance one step but the lug A of the latter pushes the pinion 40 one step, such that the tens disk 24 advances to the position 1. The display is then 10.

The same applies on the night of the nineteenth but it is the lug B which moves the tens disk 24 to the position 2. The display then becomes 20.

The same applies yet again on the night of the twenty ninth and it is the lug C which pushes the tens disk 24 to the first position 3. The display is therefore 30.

On the night of the thirtieth, the units disk 22 advances to the position 1 and the lug D pushes the tens disks 24 to the second position 3. The display is then 31.

Finally, on the night of the thirty first, because of the tooth missing from the additional crown wheel 14, the units disk 22 does not move and continues to display the digit 1. However, the sixth tooth 44 of the pinion 40 is knocked by a tooth of the ring 14 and pushes the tens disk 24 to the position 0. The display thus moves to 01.

Naturally, every night that has not been given a special description, the mechanism merely advances the units disk 22 by one step without touching the tens disk 24 because the wheel with four lugs 38 does not touch the pinion with five teeth 40.

The invention claimed is:

1. A timepiece displaying the day of the month, characterized in that it comprises:

two rotating disks (22, 24), at least partially overlapping, serving to display respectively the units and the tens of the days of the month, which support, regularly distributed on a peripheral ring, respectively the series of digits 0 to 9 and the series of digits 0, 1, 2, 3, 3, and are disposed in such a way as to present in juxtaposition the digits of the one with those of the other, and a mechanism for rotating these disks so that said juxtaposed digits provide an indication of the day of the month.

2. The timepiece according to claim 1, characterized in that said mechanism comprises:

a first crown wheel (12) driven to make one revolution in thirty-one days by progressing by one step per day around midnight, an additional crown wheel (14) attached to the first and possessing thirty regularly spaced teeth with the exception of two of them separated by a double space which corresponds to the absence of one tooth, a pinion with ten teeth (28) integral with the units disk (22) and driven by the teeth of the additional crown wheel (14), a wheel with thirty-one teeth (32) engaging with said pinion (28), a wheel (38) attached to the wheel with thirty-one teeth (32) and having a first (A), a second (B), a third (C) and a fourth (0) lugs distributed such that the angles between the first (A) and the second (B), the second (B) and the third (C), the fourth (D) and the first (A) are substantially 116° and that the angle between the third (C) and the fourth (D) is substantially 11.6°, and a pinion with five teeth (4) integral with the tens disk (24) and driven by said lugs (A, B, C, and D), which has an additional tooth (44) disposed in order to be driven by the teeth of the additional crown wheel (14).

3. The timepiece according to claim 2, characterized in that the two disks (22, 24) have the same radius r and in that the spindles of the pinions (28, 40) integral with these disks are separated by a distance substantially equal to 2(r−e), e being the width of the rings supporting the digits of the units and of the tens.

4. The timepiece according to claim 2, characterized in that each of said pinions (28, 40) is associated with a jumper (30, 42) serving to position it.

5. The timepiece according to claim 1, characterized in that the units disk (22) is slightly lower than the tens disk (24), which partially overlaps it in order to interact to present in juxtaposition the digits of their respective rings and is pierced, to the right of each of its digits, with an aperture (26) allowing the units digits beneath it to be seen.

6. The timepiece according to claim 3, characterized in that each of said pinions (28, 40) is associated with a jumper (30, 42) serving to position it.

7. The timepiece according to claim 2, characterized in that the units disk (22) is slightly lower than the tens disk (24), which partially overlaps it in order to interact to present in juxtaposition the digits of their respective rings and is pierced, to the right of each of its digits, with an aperture (26) allowing the units digits beneath it to be seen.

8. The timepiece according to claim 3, characterized in that the units disk (22) is slightly lower than the tens disk (24), which partially overlaps it in order to interact to present in juxtaposition the digits of their respective rings and is pierced, to the right of each of its digits, with an aperture (26) allowing the units digits beneath it to be seen.

9. The timepiece according to claim 4, characterized in that the units disk (22) is slightly lower than the tens disk (24), which partially overlaps it in order to interact to present in juxtaposition the digits of their respective rings and is pierced, to the right of each of its digits, with an aperture (26) allowing the units digits beneath it to be seen.

10. The timepiece according to claim 6, characterized in that the units disk (22) is slightly lower than the tens disk (24), which partially overlaps it in order to interact to present in juxtaposition the digits of their respective rings and is pierced, to the right of each of its digits, with an aperture (26) allowing the units digits beneath it to be seen.

* * * * *